United States Patent [19]

Eichlin

[11] 4,372,360

[45] Feb. 8, 1983

[54] SPLITTING AXE

[76] Inventor: Harold E. Eichlin, Q-West Apt. L-207, Quakertown, Pa. 18951

[21] Appl. No.: 288,058

[22] Filed: Jul. 29, 1981

[51] Int. Cl.[3] ..... B27L 7/00

[52] U.S. Cl. ..... 145/2 R; 144/193 C; 144/193 D

[58] Field of Search ..... 254/104; 145/2 R; 144/193 R, 193 D, 193 C, 193 E

[56] References Cited

U.S. PATENT DOCUMENTS 443,581 12/1890 Marshall ..... 144/193 E 1,264,776 4/1918 Cox ..... 145/2 R

*Primary Examiner*—W. D. Bray

*Attorney, Agent, or Firm*—Howson and Howson

[57] ABSTRACT

An axe which is particularly suited for splitting logs endwise comprises a head assembly having a blade member pivotally mounting a pair of links adapted to engage the wood for augmenting the splitting action when strikers carried on the head member engage the links and pivot the same. A compression spring is interposed between the blade member and the head member to enable the blade to penetrate the wood to a predetermined depth before the strikers engage the links.

12 Claims, 6 Drawing Figures

SPLITTING AXE

FIELD OF THE INVENTION

The present invention relates to wood splitting implements; more particularly, the present invention relates to axes which are particularly suited for splitting logs.

BACKGROUND OF THE INVENTION

Implements for use in splitting logs are known. Examples of such implements may be found in the following U.S. Pat. Nos.: 4,044,808; 3,865,163; 3,982,572; and 1,272,538. An axe having a chip deflecting mechanism is disclosed in U.S. Pat. No. 561,000. Apparatus utilizing a plurality of toggle links for opening a collapsed roll of sheet stock is disclosed in U.S. Pat. No. 3,749,365.

While each of the aforementioned patented implements may function satisfactorily for its intended purpose; nevertheless, there is always a need for an improved implement which is capable of splitting logs with a minimum of physical effort.

OBJECTS OF THE INVENTION

With the foregoing in mind, a primary object of the present invention is to provide a novel wood splitting implement which overcomes the limitations of known wood splitting devices.

Another object of the present invention is to provide an improved axe which is particularly suited for splitting wood with a minimum of effort.

A still further object of the present invention is to provide a unique wood splitting axe which functions effectively to split logs while at the same time being durable and relatively inexpensive to manufacture.

SUMMARY OF THE INVENTION

More specifically, the present invention provides an implement which is particularly suited for splitting logs into firewood. The implement comprises a head assembly and means connected to the head assembly for propelling the head assembly against a cut end of a log. The head assembly comprises a base member, a blade member having an edge adapted to engage the log, and means mounting the blade member for movement relative to the base member. A pair of toggle links are pivotally mounted to the blade member which is biased away from the base member by means of a compression spring interposed therebetween. Each toggle link has a working edge disposed to one side of the blade member adjacent its edge and has a head on the other side of the blade. A pair of strikers are carried on the base member in spaced relation with the heads of the links for contacting the heads and rotating the links relative to one another. The links are normally disposed with their working edges close to the edge of the blade members by means of extension springs. The compression spring functions to enable the blade edge to penetrate the log to a predetermined depth before the strikers engage the toggle links to pivot the same outwardly for separating the split sections of the log.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
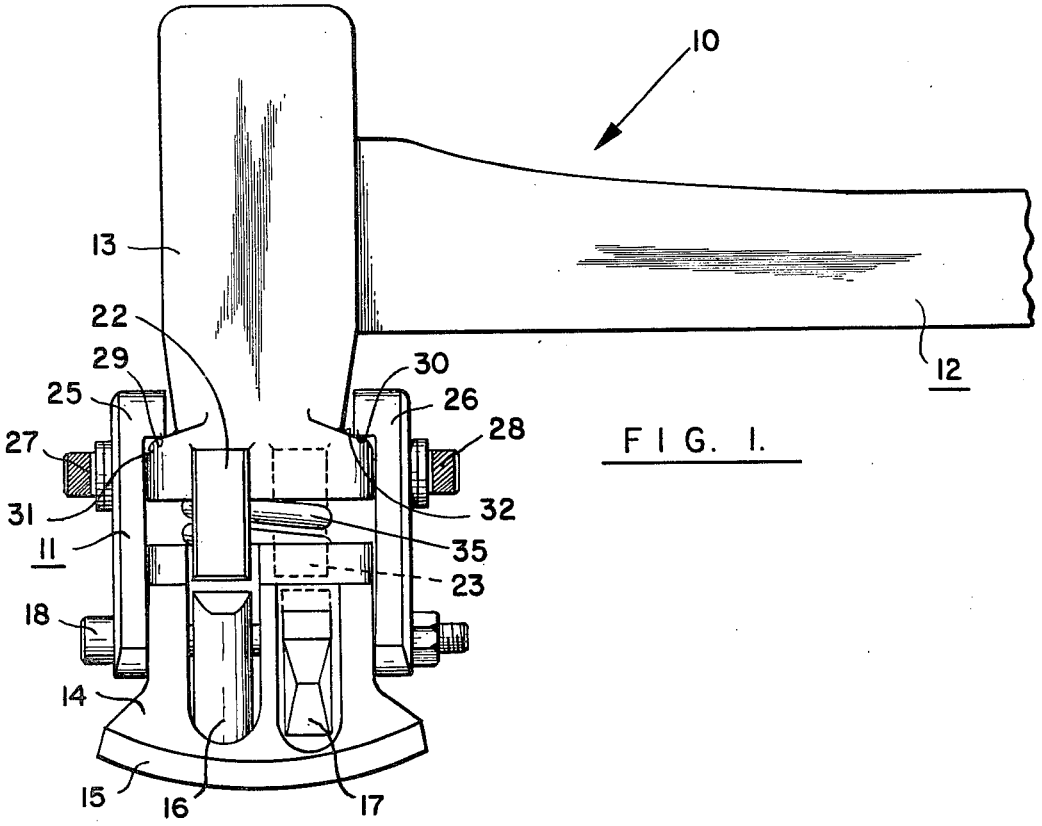
FIG. 1 is a side elevational view of a wood splitting implement embodying the present invention.

Referring now to the drawings, FIG. 1 illustrates a wood splitting implement 10 which embodies the present invention. In the illustrated embodiment, the implement 10 comprises a splitting head assembly indicated generally at 11 and means for propelling the head assembly 11 against the endwise grain of a log. In the present instance, the propelling means includes a handle 12 secured to the head assembly 11 in a conventional manner, such as illustrated in FIGS. 2 and 3.

The head assembly 11 comprises a base member 13 which is securely fastened to the handle 12 and a blade member 14 having a cutting edge 15 along its lowermost extremity. A pair of toggle links 16 and 17 are pivotally mounted to the blade member 14 by means of a bolt 18 which lies in the plane of the edge 15 intermediate the edge 15 and the base member 13.

Figure 2:
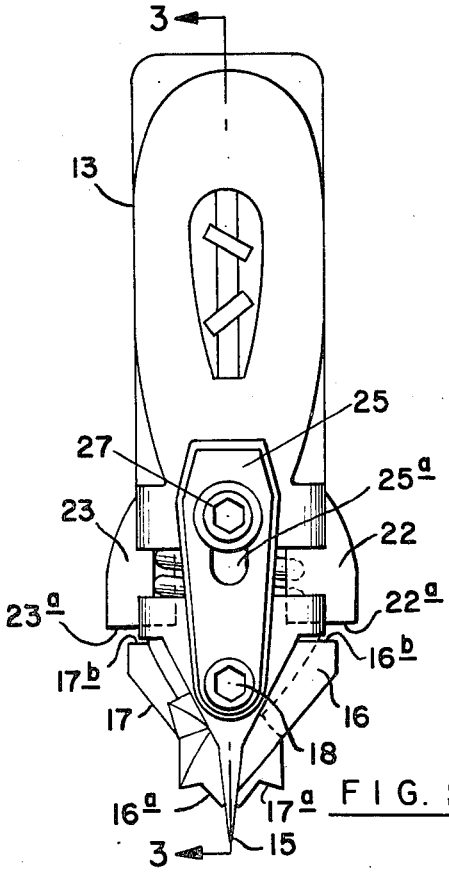
FIG. 2 is an end elevational view looking rightward in FIG. 1.
Figure 3:
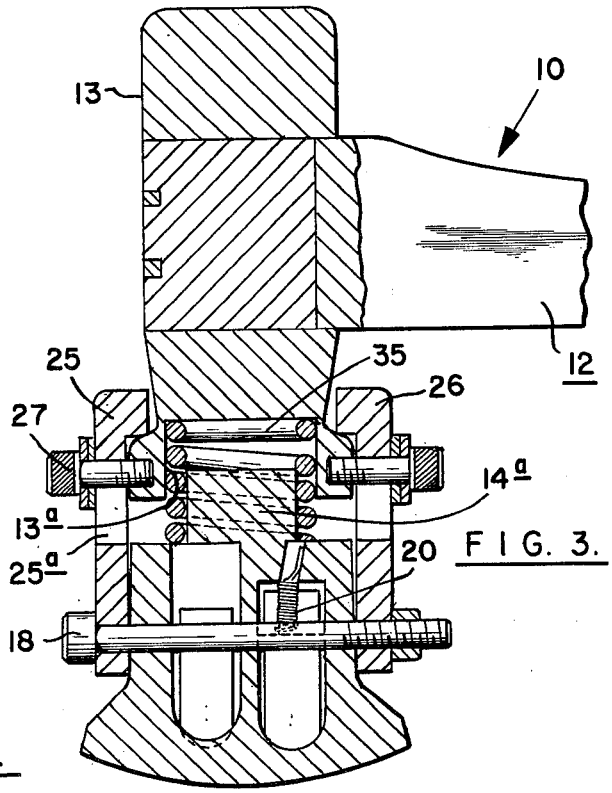
FIG. 3 is a sectional view taken on line 3—3 of FIG. 2.
Figure 4:
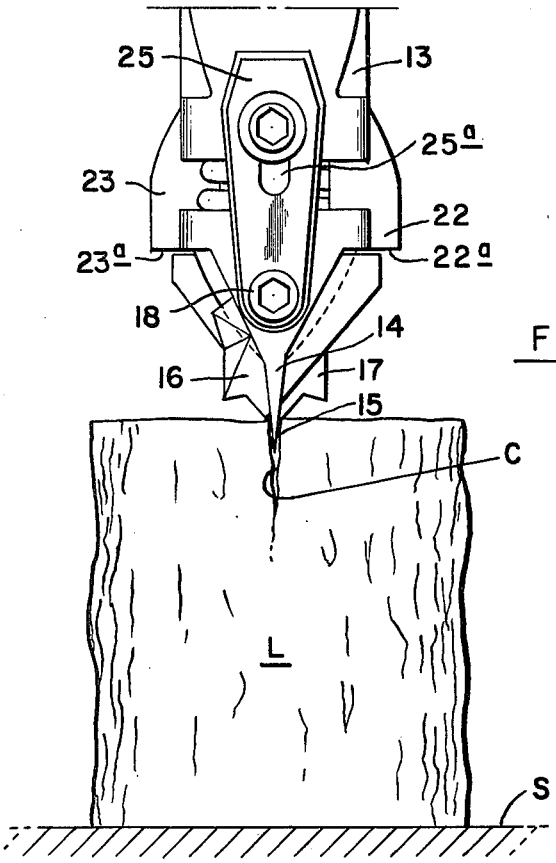
FIG. 4 is a fragmentary end elevational view similar to FIG. 2 but illustrating the splitting implement in the process of splitting a log.
Figure 5:
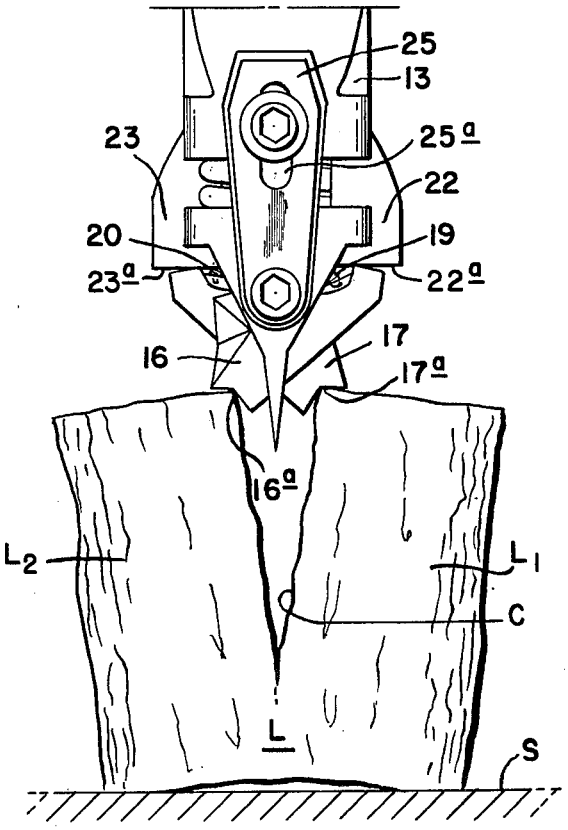
FIG. 5 is a view similar to FIG. 4 but illustrating the relative movement of the parts as the implement begins to split the log.

As best seen in FIG. 2, each link, such as the link 16, has a working surface **16*a* disposed to one side of the blade edge 15 and a head 16*b* disposed on the side of the blade edge 15 opposite the working surface 16*a*. The other link 17 has similar surfaces 17*a* and 17*b*. Preferably, the working surfaces 16*a* and 17*a* have a concave configuration defining a bight which is adapted to engage the log in a manner to be described. The links 16 and 17 are maintained in their home positions illustrated in FIG. 2 by means of a pair of extension springs 19 and 20 (FIG. 5). Such connection of the spring 20 is illustrated in FIG. 3. The springs function to maintain the working surfaces 16*a* and 17*a* of the links 16 and 17, respectively closely adjacent opposite sides of the blade edge 15**.

The links pivot to augment the splitting action of the blade edge 15. To this end, the base member 13 carries a pair of strikers 22 and 23 each of which has a lower striking surface **22*a* and 23*a* (FIG. 2) disposed in spaced relation with respect to the heads 16*b* and 17*b* of the links 16 and 17, respectively. The strikers function in a manner to be described to pivot the links 16 and 17 relative to the blade member 14** to effect the desired splitting action.

In order to enable the operating surfaces **22*a* and 23*a* of the strikers 22 and 23 to engage the heads 16*b* and 17*b* of the links 16 and 17, means is provided for mounting the blade member 14 for movement relative to the head member 13. In the illustrated embodiment, the mounting means comprises a pair of brackets 25 and 26 disposed on opposite sides of the head member 13 and lying in a plane beneath the plane of the handle 12. As best seen in FIG. 1, holes are provided in the lower end of each bracket for receiving the bolt 18 which pivotally mounts the toggle links 16 and 17. Each bracket, such as the bracket 25 also has a vertically elongated slot 25***a* which receives a cap screw 27 which is threaded into the base member 13 adjacent its lower end. A similar structure and cap screw 28 is provided for the bracket 26. The upper ends of the brackets 25 and 26 are provided with inturned portions 29 and 30 which normally project into a recessed portion of the base member 13 to engage shoulders 31 and 32 provided thereon. Thus, the upper ends of the bracket cooperate with the base member 13 to limit outward movement of the blade member 14 relative to the base member 13 while the slots in the bracket permit inward relative movement between the blade member 14 and the base member 13.

For the purpose of maintaining the desired separation between the heads 16*b* and 17*b* of the links 16 and 17 and the striker surfaces 22*a* and 23*a*, and for other purposes to be described, a compression spring 35 is interposed between the blade member 14 and the base member 13. As best seen in FIG. 3, the compression spring 35 is mounted in a cylindrical recess 13*a* provided in the lower end of the base member 13. The upper end of the blade member 14 is provided with a cylindrical protrusion 14*a* which engages interiorly of the coils of the compression spring 35. Thus, the compression spring 35 functions to bias the blade member 14 away from the base member 13 for causing the parts to assume the static positions illustrated in FIGS. 1–3.

The compression spring 35 is of a predetermined design and is maintained under a preload of a particular level. Experiments have shown that the spring should be maintained under a preload of at least about 200 lbs. and should have a gradient of 400 lbs. per inch. The spring should be capable of deflecting about ½ inch total. Moreover, it is preferable for the spring to be designed so that its coils do not bottom out before the upper end of the post 14*a* engages the bottom of the recess 13*a* in the head member 13.

The operation of the implement 10 will now be described.

As customary in splitting logs, a short length of a cut log L is placed on a support surface S. The axe 10 is gripped by the handle 12 in the usual manner and swung by the user in such a manner as to cause the blade edge 15 to strike the upper end of the log L along a diagonal line. This causes a crack C to be formed in the upper end of the log L as the blade edge 15 penetrates the log L to a predetermined depth. At this point in time, it will be noted that the strikers 22 and 23 begin to advance toward the heads of the links 16 and 17 as the compression spring 35 starts to be compressed between the blade member 14 and the base member 13.

Figure 6:
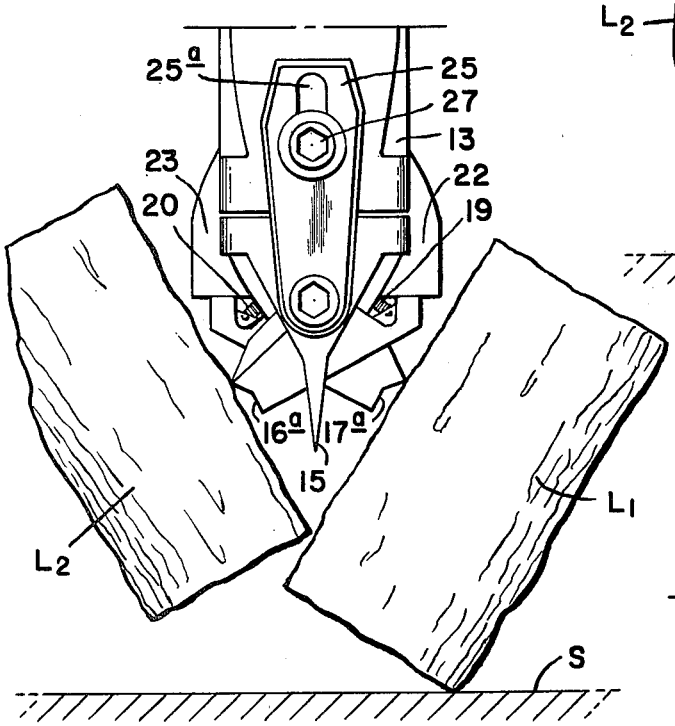
FIG. 6 is a view similar to FIG. 5 but illustrating further relative movement of the parts as the implement advances through the log during splitting.

The momentum of the base member 13 relative to the blade member 15 causes the strikers 22 and 23 to move downwardly relative to the heads of the links 16 and 17 and to engage the same in the manner illustrated in FIG. 5 to cause the links to pivot about the bolt 18. The working surfaces 16*a* and 17*a* of the links 16 and 17 engage the inside upper edges of the log L in the manner illustrated in FIG. 5 while the strikers 22 and 23 continue to pivot the links relative to one another. This causes the log L to begin to form two halves $L_1$ and $L_2$. It is noted that the extension springs 19 and 20 begin to extend as the links 16 and 17 begin to pivot. In this position, the links 16 and 17 begin to apply an outward pressure to the upper inside edges of the log L to initiate an augmented splitting action. This action continues with the blade member 14 moving further upwardly relative to the base member 13 and compressing the spring 35 to enable the links 16 and 17 to pivot further relative to one another for further forcing apart the log sections $L_1$ and $L_2$. See FIG. 6. After the log has been split, the compression spring 35 and the extension springs 19 and 20 function to return the parts to their normal positions to be ready for the next swing of the axe handle.

While the precise theory by which the invention functions to split wood cannot be fully explained, it is believed that the spring cooperates with the head and blade members and the spacings between the strikers and the heads of the links to permit the blade edge to penetrate the log to a predetermined depth before the links engage the log and before the strikers engage the links with a sudden force to force the log apart. The preload of the spring combined with its gradient enables the relative movement between the blade member and the head member to be delayed slightly so that maximum impact by the links on the log can be achieved. Thus, the spring provides somewhat of a timing function which has been found beneficial in splitting logs. The spring also absorbs some of the shock of impact and assists in minimizing the transmission of vibrations through the handle and to the hands of the user. To minimize effort on the part of the user, the total weight of the head and handle assembly should be less than 12 lbs.

In view of the foregoing, it should be apparent that the present invention now provides an improved implement for splitting firewood. The implement is capable of splitting readily even difficult to split logs. Usually, a typical firewood log having a diameter of about 12 inches can be split with a single blow. The axe is readily portable and can, therefore, be used in remote locations. Because the axe is of a relatively simple design which requires a minimum of moving parts, it can be manufactured economically by high-speed mass production techniques.

While a preferred embodiment of the present invention has been described in detail, various modifications, alterations and changes may be made without departing from the spirit and scope of the present invention as defined in the appended claims.

I claim:

1. An implement particularly suited for splitting firewood, comprising: a head assembly and means connected to said head assembly for propelling the head assembly toward a log, said head assembly including:

a base member, a blade member having an edge adapted to engage the wood, means mounting said blade member for movement relative to said base member, means interposed between said base and blade members for biasing said blade member away from said base member, a pair of toggle links pivotally mounted to said blade member, each link having a working edge disposed to one side of said blade adjacent its edge and having a head on the other side of said blade remote from its edge, striker means carried on said base member in spaced relation with said link heads for contacting said heads and rotating the links relative to one another, and means connected to said toggle links for elastically urging said heads into proximity with said striker means, whereby the biasing means enables the blade edge to penetrate the wood to a predetermined depth before the striker means engages the heads of the toggle links to augment the splitting action of the blade edge.

2. An implement according to claim 1 wherein said biasing means includes a compression spring having a predetermined gradient and preload.

3. An implement according to claim 2 wherein said gradient is about 400 lbs./in.

4. An implement according to claim 3 wherein said preload is at least about 200 lbs.

5. An implement according to claim 1 wherein said biasing means includes a compression spring.

6. An implement according to claim 5 wherein said base member has a recess receiving one end of said compression spring and said blade member has means engaging the other end of said compression spring.

7. An implement according to claim 6 wherein said spring engaging means includes a stem projecting into the interior of said spring.

8. An implement according to claim 1 wherein said blade member to base member mounting means includes a pair of slides connected at their lower ends to said blade member and having elongated slots adjacent their upper ends, and bolts extending from the base member and through said slots to afford said relative motion between said blade member said base member.

9. An implement according to claim 8 wherein said slides are connected to said blade member by a common bolt, and said toggle links are pivotally mounted on said common bolt.

10. An implement according to claim 9 wherein said common bolt lies in a plane common to said blade edge.

11. An implement according to claim 1 wherein said striker means includes a pair of fingers depending from opposite sides of said base member and aligned with the heads of said toggle links.

12. An implement according to claim 1 wherein said elastic urging means for said toggle links include extension springs connected between said blade member and said links.

* * * * *